US006318113B1

(12) United States Patent
Levy et al.

(10) Patent No.: US 6,318,113 B1
(45) Date of Patent: Nov. 20, 2001

(54) PERSONALIZED AIR CONDITIONED SYSTEM

(76) Inventors: Hans F. Levy, 4351 Gulf Shore Blvd. PH 6, Naples, FL (US) 34103; Peter G. Betz, 7686 Santa Margherita Way, Naples, FL (US) 34109

( * ) Notice: Subject to any disclaimer, the term of this patent is extended or adjusted under 35 U.S.C. 154(b) by 0 days.

(21) Appl. No.: 09/592,357

(22) Filed: Jun. 12, 2000

(51) Int. Cl.[7] ..... F25D 17/06
(52) U.S. Cl. ..... 62/426; 62/419; 454/306
(58) Field of Search ..... 62/426, 419; 454/306

(56) References Cited

U.S. PATENT DOCUMENTS

| | | | | |
|---|---|---|---|---|
| 4,351,475 | * | 9/1982 | Hudson | 237/46 |
| 4,775,001 | * | 10/1988 | Ward et al. | 165/22 |
| 4,872,397 | * | 10/1989 | Demeter et al. | 98/31.6 |
| 5,238,452 | * | 8/1993 | Levy et al. | 454/306 |
| 5,358,444 | * | 10/1994 | Helm et al. | 454/306 |
| 5,360,374 | * | 11/1994 | Wyon et al. | 454/306 |
| 5,624,312 | * | 4/1997 | Collier | 454/247 |

* cited by examiner

*Primary Examiner*—William Doerrler
*Assistant Examiner*—Mark S. Shulman

(57) ABSTRACT

The invention involves the personal air conditioning of individual workstations in an open office space layout. The individual workstation's air is supplied by a major air plenum located under a horizontal surface of the workstation. The conditioned air is directed by a smaller self-contained air terminal located under a floor representing a larger major air plenum or chamber. The conditioned air is supplied to the individual workstations at or near the atmospheric pressure. The multiple of smaller air terminals are the movers of the conditioned air by way of driving fans installed therein and activated as the need arises. The conditioned air is moved from the smaller air terminals by flexible air tubes to the air plenum mounted under the desk surface. A person situated at the workstation can control the direction of air emanating from the front of the personalized air outlet plenum toward the person in multiple directions. Further, the person can also control the volume of the personal air by being able to divert some of the air away from the person through a wall in the desk or through a wall of a room partition to an adjoining space. The person at the workstation has the option of dividing the main air stream either to a frontal outlet directed at the person or to an outlet away from the person to enter the general atmosphere of the work space.

10 Claims, 7 Drawing Sheets

PERSONALIZED AIR CONDITIONED SYSTEM

FIELD OF THE INVENTION

The invention at hand relates to either heating or cooling the ambient air, hereinafter referred to as air conditioning. The invention is directed primarily to the personal comfort of a person working at a particular workstation or desk by directing conditioned air to the immediate vicinity of those persons present, particularly their upper body portion, at those workstations and by giving those persons control over the flow and direction of the conditioned air.

BACKGROUND OF THE INVENTION

In the field of heating and air conditioning, there are known problems causing discomfort to the occupants, inefficiencies in the system resulting in excessive operating costs in operating a building, and problems in the operation and control of the present systems.

For example, a central building control of temperature, air flow, humidity, and the like, or even individual rooms and workstations leaves many persons in the building or within a room or in the vicinity of a workstation uncomfortable or dissatisfied with the condition of their particular work environment. Different people have different metabolisms and therefore differing comfort needs. Also different locations in a building, or even in a single room or closer yet in the vicinity of a workstation, are not satisfactorily heated or cooled, that is air conditioned, giving rise to complaints about discomfort and illness, resulting in absenteeism, sickness and, of course, loss of productivity.

Further, conventional air conditioning systems generally require expensive duct work and installations, usually in floors or ceilings or both which cause unnecessary heating or cooling of unused space, particularly the spaces that surround the duct work and spaces above the head level of the occupants. For example, the upper four feet of space in a room having a twelve foot ceiling is an unoccupied space and the air in that space need not be be controlled. The above mentioned duct work also imposes a substantial energy demand for the movement of air through the ducts and additionally presents difficulties in cleaning the ducts.

Prior and known systems with fixed floor or wall mounted air outlet grilles limited the location of furniture and equipment in a manner which would block the flow of air. Such prior systems also created areas of complaints and discomfort caused by high or low air velocity and/or high or low temperature depending upon the location and the proximity of the air outlet grilles. Also, air conditioning outlet grilles and ducts frequently need to be moved to accommodate changes in air conditioning load or the rearrangement of the work space or the individual workstations in an open space office layout, for example.

In today's world of large office buildings, not only in height but also in the expanse of the floors, it has become a design objective to provide individual work spaces and individual workstations in generally wide open rooms. That is, instead of providing each occupant with his or her own permanent, generally enclosed room or office, a number of workstations or cubicles are provided with each having partitions or room dividers which partially enclose the space to create a separate work space, which partitions or dividers do not extend to the ceiling of the room. Often, these workstations include two, three or more partitions for the purpose of providing the worker with a feeling of privacy.

While such workstations may be economically beneficial with regard to the amount of floor space being used, the partitions create an impediment to flow of the conditioned air throughout the room. That is, conditioned air flows freely in the area above and around the workstations, but within the workstations or between the room dividers there is no means for providing the workstation occupant with an acceptable flow of conditioned air. Therefore, the workers often become uncomfortable, or even ill, which in turn decreases productivity and/or causes absenteeism.

Consequently, in the field of heating or cooling air, there exists a need for providing a flow of conditioned air directly to or near a person seated at a workstation as well as to occupants of the surrounding area. More particularly there exists a need for a workstation to be so equipped wherein the occupant can individually control and obtain the amount of conditioned air supplied within the workstation for maximizing the comfort, well being, health and level of productivity of each worker, while maintaining a desirable flow of conditioned air to the surrounding area.

Conventional room dividers for workstations may supply conditioned air to workstations, which conditioned air flows through an air flow grille at about the height where the workers is seated but the worker has very little control over the flow of the air or its direction. Such room dividers consist of a hollow space being created by panels spaced from each other by a predetermined distance to define an air flow there between. The hollow room divider or partition is placed on an opening in the floor which floor is spaced above the slab of the building floor to thereby form a large or major air plenum having conditioned air contained therein having a pressure at or near the atmospheric pressure. Applicants' prior Pat. Nos. 4,646,966; 4,860,642; 5,135,436; 5,238,452 are directed to this type of installation and to the control of the environment in an open office space. Applicants' present inventive concept is directed to an under the desk air terminal. There are other attempts in the prior art to bring conditioned air as close to a person or worker as is possible and to give this person or worker some semblance of control of the conditioned air.

U.S. Pat. No. 374,424 discloses a device for supplying fresh air to the environment of an auditorium and where the air blows directly to the chair of the occupant without any mechanical intervention.

U.S. Pat. No. 1,194,527 shows the ventilation of a class room wherein the outside air under pressure enters the class room through a ventilated floor panel and is further distributed into the desk where the pupil is sitting. The pupil may have some control over the amount of flow to or through the desk. In both of the previously cited patents the air flow is not conditioned or modified as to heat or cold.

U.S. Pat. No. 2,140,829 describes an air conditioning system wherein there is a cooling of high ceiling rooms by providing a stratum of cooled and dehumidified air in the lower levels of the room up to a height of the occupants without undertaking the relatively great cost and complication of treating all the air in the room.

U.S. Pat. No. 2,341,125 illustrates a way of ventilating a desk as a workstation by simply mounting a fan within a rear of the desk and by blowing air at the person and by given the person working at the desk somewhat of a control of the fan by positioning the same or by controlling the speed of the air flow.

U.S. Pat. No. 2,507,643 teaches the ventilation of restaurant equipment by supplying air to and from restaurant table and chair equipment. The person or persons seated at the equipment have no control over the flow and direction of the flow of air.

U.S. Pat. No. 2,572,120 shows a ventilated table having a fan mounted in a horizontal position which is emitting air in a horizontal direction and air flows out of he lateral sides of the table.

U.S. Pat. No. 2,616,617 illustrates a ventilated table similarly constructed as the table in the immediately cited patent above.

U.S. Pat. No. 2,734,990 discloses a desk as a workstation having a combination fan and heater mounted therein. The fan blows conditioned air (heat) directly at the person sitting at the desk. The direction of the air flow is adjustable by tilting the fan in one direction or the other and the level of heat is adjustable by way of a rheostat.

U.S. Pat. No. 2,835,186 discloses an air conditioning system wherein there are upstanding air emission columns receiving conditioned air through ducts in the floor of the system. It is considered to be a local or spot air conditioning system.

U.S. Pat. No. 2,877,990 discloses a novel building structure embodying a multi-cellular load supporting floor having a novel air distributing and electrical wiring system therein wherein both heated or cooled air and electrical wiring are distributed through selected ones of the cells of the floor U.S. Pat. No. 3,322,055 teaches the elimination of duct work in a building by adding fan driven diffusers in the ceiling whereby the air chamber in the ceiling may be used as an unpressurized distribution chamber.

U.S. Pat. No. 3,516,347 shows the use of a double plenum air conditioning system creating a space between a structural slab and the floor or roof above of a building and the double plenum is divided by a horizontal partition into an upper and a lower plenum and to one of the plenums a supply air is fed and from the other of the plenums return air is withdrawn. The supply of air can be hot, cold or neutral. Inlets and outlets connect the plenums through the slab to the room below or through the floor to the room above.

U.S. Pat. No. 4,035,018 discloses a system whereby conditioned air is distributed through a floor plenum to a multiple of chairs having an exhaust contained in each one of the chairs to expel the conditioned air into the general environment of the room. The occupants of the chairs have no control over the speed and direction of the air flowing into the room.

U.S. Pat. No. 4,135,440 illustrates an air conditioning system having both ceiling and floor plenums and each of the plenums has individual air outlets diffusing into the room between the plenums. In addition there are individual elongated air outlet tubes suspended from the ceiling plenum or upstanding from the floor plenum. Each of the outlet tubes can be directed against a person sitting at a workstation. The respective person has control over the direction of the air emanating from the outlets.

U.S. Pat. No. 4,378,727 shows an open space office system including a plurality of freestanding workstations which are constructed of vertical panels and horizontal work surfaces. The room in which the workstations are arranged are provided with central ventilation means which provides air circulation within the room. Each workstation includes at least one common conduit arranged adjacent the work surface thereof. A vent disposed in each of the workstations communicates with the conduit thereby providing an air flow path from the central ventilation system through the room to the conduit.

U.S. Pat. No. 4,531,454 is directed to an air conditioning system in a building with floor tiles covering an under floor plenum of an air conditioning system. There are flexible ducts leading from an air conditioning unit. At the end of each flexible duct is a fan air terminal. Each of the fan units can discharge conditioned air from the floor into the general atmosphere of the room.

U.S. Pat. No. 4,775,001 discloses a zoned air conditioning system using a room air terminal which has the same horizontal dimensions as a floor tile of a raised tile floor such that the terminal may replace one tile in such a floor. The terminal includes a cool air inlet below the floor for drawing in cooling air circulated in the under floor space and a return air inlet in the top surface of the terminal. An upstanding air duct, taking air from underneath the floor plenum, may blow conditioned air against a person sitting at a workstation.

U.S. Pat. No. 4,872,397 illustrates a personal environmental module for controlling the environment of a workstation. The module includes a housing having an air inlet and a pair of air outlets with a pair of dampers mounted in the air inlet and one of the dampers is connected to a predetermined air source and the other damper is connected to room air. The above noted personal environmental module (PEM) enables each worker to control the air temperature, air flow, noise level, light level and radiant heat at the workstation.

U.S. Pat. No. 5,154,498 is directed to a portable desk apparatus including among other things a modification which includes a cooling housing selectively and removably mounted to an upper board member to direct cooling air to a user of the organization permitting its use in a convenient manner in various environments.

Another known air conditioned workstation is known under the word "Climadesk". It is described as a plenum which is installed under the top of a desk. The air plenum has an inlet to receive conditioned air from an air conditioning unit being placed apart but adjacent the desk. The air conditioning unit receives fresh air from the outside of the building through an air intake vent. The air plenum installed under the top surface of the desk directs the conditioned air toward a person sitting at the desk. The conditioned air is exiting toward the person by way of two front louvers and is further directed upwardly from the top surface of the desk in front of the person sitting at the desk. The temperature of the conditioned air can be controlled by way of a thermostat located on a front panel of the desk. This kind of an arrangement greatly reduces the mobility of such a workstation and thereby eliminates an effective arrangement of all of the workstations in an open office concept.

German published specification (Offenlegungsschrift) No. 24 07 448 discloses a workstation in the form of a desk receiving conditioning air by way of a flexible hose through the floor having air ducts therein. The occupant at the desk has no control over the flow of the air with regard to direction and/or speed.

German published specification (Offenlegungsschrift) No. 27 19 570 discloses a similar system as was disclosed in the German publication supra. In this arrangement conditioned air is supplied by way of ducts located below the floor of the open office area. From there the conditioned air is funneled by way of upstanding tubes located at each of the workstations. The conditioned air is blown into the room at a location above the desk surface at each of the workstations. The occupant at the desk has some control over the speed and direction of the air flowing through the outlets of the upstanding tubes.

German published specification (Offenlegungsschrift) No. 29 38 702 is similar to both German publications discussed above and does not add any more knowledge to the already known prior art.

Japanese Patent No. 61-11535 discloses an air conditioning system having a floor air plenum installed over a floor slab of a building. The conditioned air is driven by a fan into a hollow partition situated over an opening in the floor. Conditioned air may exit at a higher elevation than the height of a desk into the room. At the bottom of the floor whereupon the desk is located, there is a further air outlet which is directing conditioned air to the feet of a person sitting at the desk. It appears that said person has very little control over the amount, speed and direction over the conditioned air entering the vicinity of the desk.

SUMMARY OF THE INVENTION

In summary, the objects of the invention are to create a personalized air conditioned Workstation which achieves complete personalized comfort control at all workstations in an open office environment. The single system simultaneously provides both personal comfort control and thermostatic space control. The system includes an immediate response for personal comfort, meaning, there is no delay for system adjustment. There will also be a cleaner air environment because the air is not being recirculated within the room. Fresher air is being obtained because of greater ventilation efficiency. There is also less cross air contamination between workstations.

The overall building operating efficiency will be improved because less A/C (Air Conditioning) equipment needs to be installed which will require less building space and a minimal use of duct work. Therefore, there will be overall savings in installation costs. All of the above results in quicker, easier and less costly configuration and reconfiguration of workstations.

DETAILED DESCRIPTION OF THE INVENTION

Figure 1:
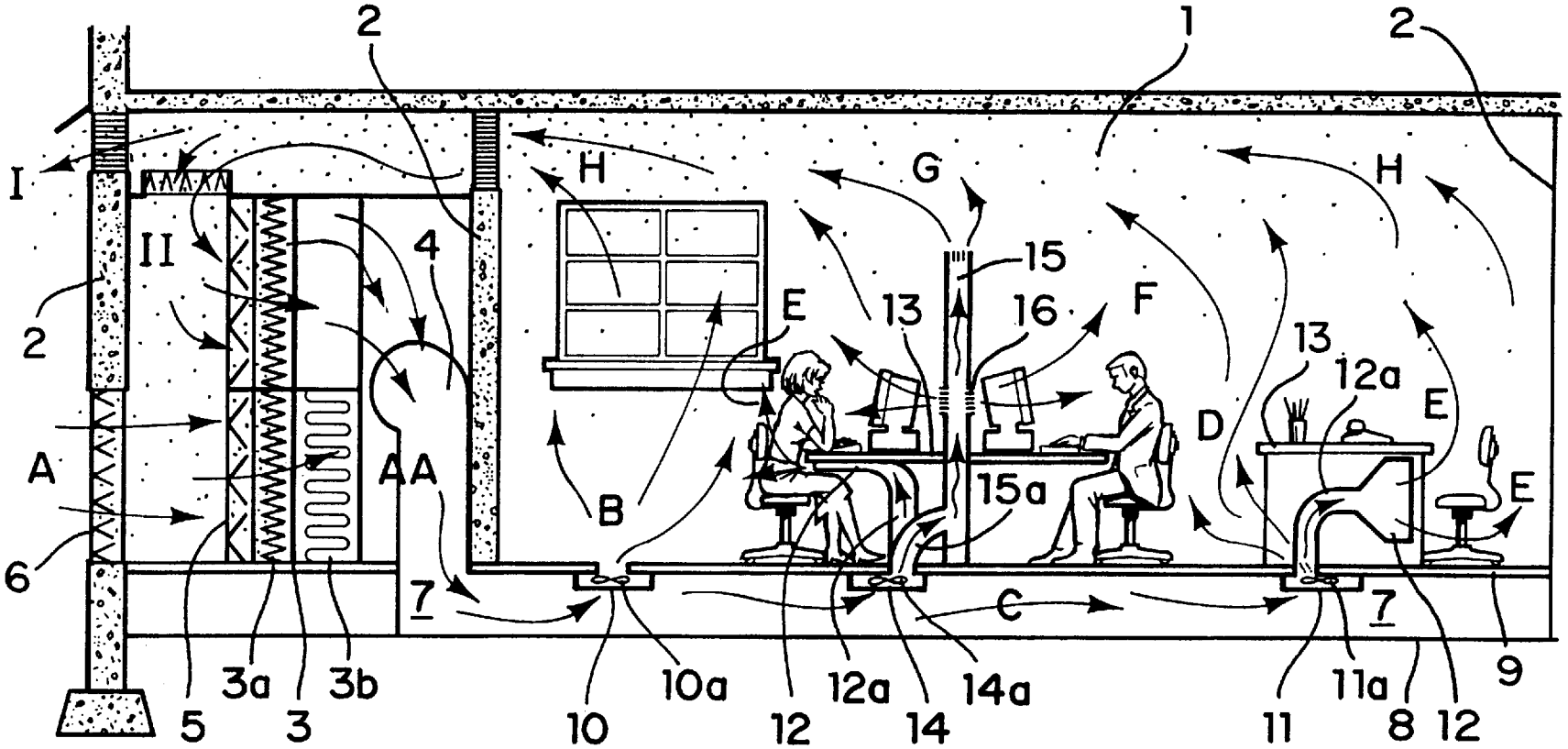
FIG. 1 illustrates the overall personal air control system.

FIG. 1 illustrates a complete personal air control system showing different possible variations of workstations as could be used or arranged in an open office layout. Numeral 1 depicts a large air conditioned space having walls 2 which may be intermediate walls or end walls of the building. The air conditioning plant is shown at 3 which plant may supply heated or cooled air into the open office 1 by way of an air mover 4. Fresh outside air (arrows A) is pulled into the conditioning plant 3 through an outside air intake or louver 6, through dampers 5 and the filters 3*a*, and the heat exchanger 3*b*. Thereafter, the conditioned air (arrows AA) is advanced into the below floor major air plenum or air chamber 7 which extends completely under the working floor 9. The under floor air chamber or plenum 7 is formed by the concrete slab 8 of the building and by a raised working floor 9. The air plenum is also useful for stringing utility wires to various electrical terminals wherever needed or desired. Also various wires can be placed within the air plenum 7 to accommodate telephone and computer outlets. In this context, water pipes can also be placed therein for water fountains or for a sprinkler system wherein the sprinkler heads would penetrate through the concrete slab to the floor below as the building code requires. The air pressure is stabilized at or near the atmospheric pressure which will be explained below.

The conditioned air in the major air chamber or plenum 7 (arrow C) can now be tapped for many different applications or uses simply by removing tiles installed in the floor for this purpose. Thus, at 10 there is shown a simple smaller and self-contained floor air terminal 10 having a fan 10*a* therein which pushes air upwardly (arrows B) into the general environment of the room 1. Of course, a properly designed grille will have to cover the opening in the floor.

At the far right side of FIG. 1 there is shown another possible and useful installation as a self-contained air terminal at 11 having a fan 1la therein. The fan 11*a* will push conditioned air into the air plenum 12 installed in the desk 13. The air plenum in this installation is installed in a vertical position although it can be installed in a horizontal position as will be seen in later FIGS. The conditioned air is moved into the plenum 12 by a flexible air tube 12*a* attached to the under floor air terminal 11. The conditioned air exits through adjustable louvers (shown later) toward to a person sitting at the desk in the direction of (arrows E). In addition, some of the conditioned air can also be diverted and moved into the general environment of the office space as is shown by (arrows D). Later FIGS., in the description, will explain this method in greater detail.

Still another possible arrangement or installation can be seen in the middle of FIG. 1. Again a smaller under floor self-contained air terminal 14 is installed having a fan 14*a*. The fan 14*a* pushes the conditioned air into the plenum 12 by way of a flexible tube 12*a*. The horizontal plenum 12 directs the conditioned air toward the upper portion of a person sitting at the desk 13 (notice arrows E). In this installation use is made of a hollow workstation partition 15 into which conditioned air is pushed by way of a flexible air tube 15*a*. The air is pushed upwardly and may exit as a flow (arrow G) on top of the hollow partition or it may be somewhat diverted through an air outlet grill 16 in a lower part of the partition. The air is directed (arrow F) toward a person sitting at a desk on the other side of the partition. The known phenomena of warmer air rising is taken advantage of in this installation in that the spent air rises to the top of the room, see (Arrows H), and a portion of the return stream (arrow 1) exits into the outside atmosphere. Another portion of the return air is returned into the air conditioning plant 3 (arrows 11). The method of operating the above described personal air control system will be explained at the end of the specification.

Figure 2:
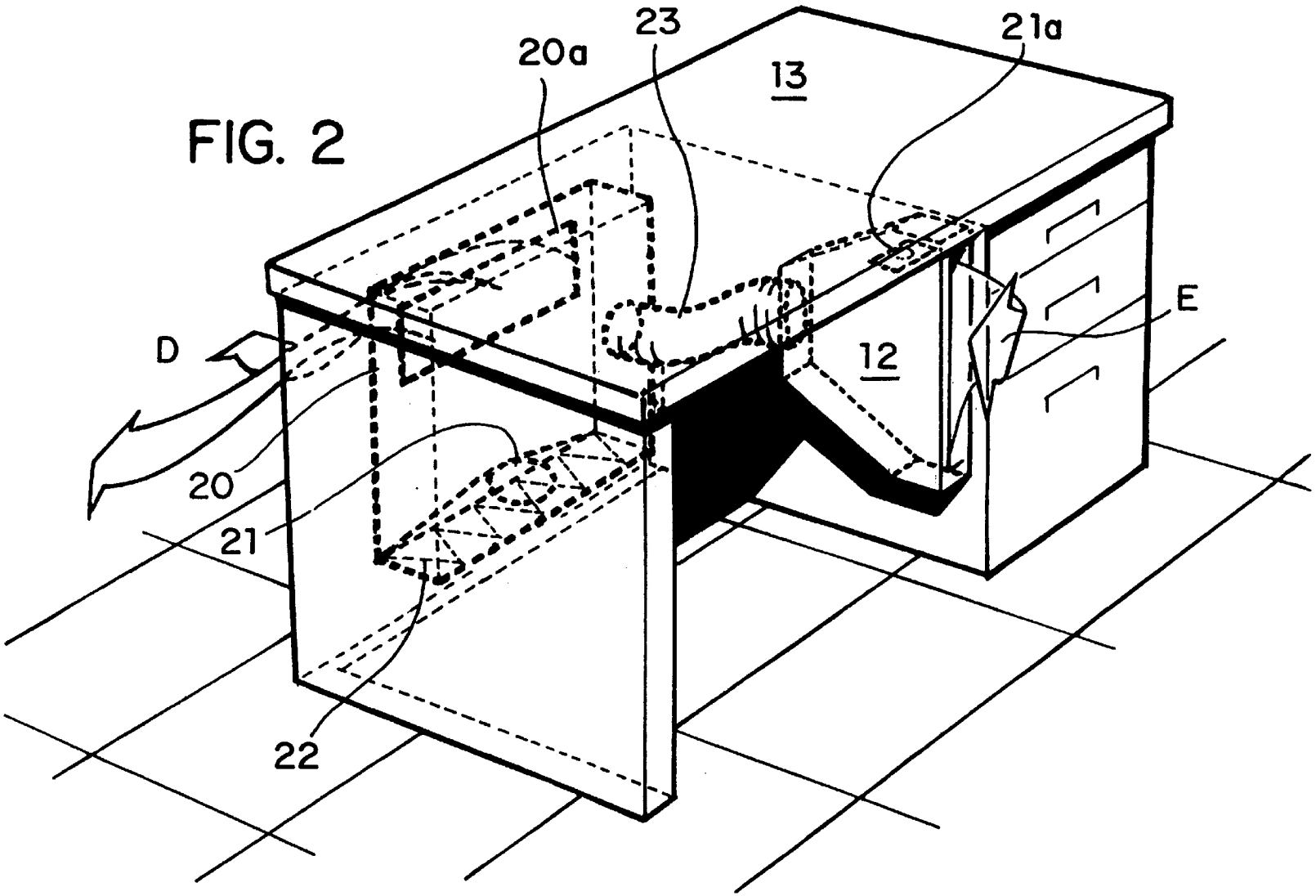
FIG. 2 is a perspective view of a workstation having a self-contained air system.

Turning now to FIG. 2, there is shown the simplest way of increasing the personal comfort level of a person sitting at the desk 13. It is pointed out that like reference characters are used in this FIG. as well as in all subsequent Figs as were used in FIG. 1 so as to direct attention to the same elements identified in FIG. 1. To this end, there is shown an air plenum 12 which is mounted on a side of the desk 13 but it could also be mounted in a horizontal position under the top of the desk which is a matter of choice and convenience. The air plenum 12 is connected to an air plenum or flat box 20 mounted in the back of the desk 13. The connection is made by a flexible air hose 23. Within the air plenum 20 there is mounted a centrifugal air fan 21 which will suck air into the bottom of the air plenum 20 by way of a filter 22 located therein. The speed of the fan, and thereby the amount of air traveling, and the on and off state of the fan 21, will be controlled by a switch 21a of the dimmer type which is a well known feature in other applications in electrical systems. As will be explained below, the air stream will flow in the direction (arrow E) to the person sitting at the desk. that person has control over the direction and the amount of air emanating form the front of the plenum 12. The more air is directed toward the person the less air will be expelled from a louver 20*a* in the back of the desk 13 and into the surrounding environment, notice (arrow D). Of course, the state of the conditioned air that is passed to the person sitting at the desk 13 depends upon the state of the general environment in the vicinity of the desk. This, however, gives the person at the desk an improved level of comfort. Another feature of this type desk improves the general planning of the total layout of the open space office since no further connections with any elements under the floor are necessary except, perhaps, for electrical floor outlets. Another advantage of a desk equipped in this manner is that such a desk can also be used on an ordinary floor having no under floor plenum.

Figure 3:
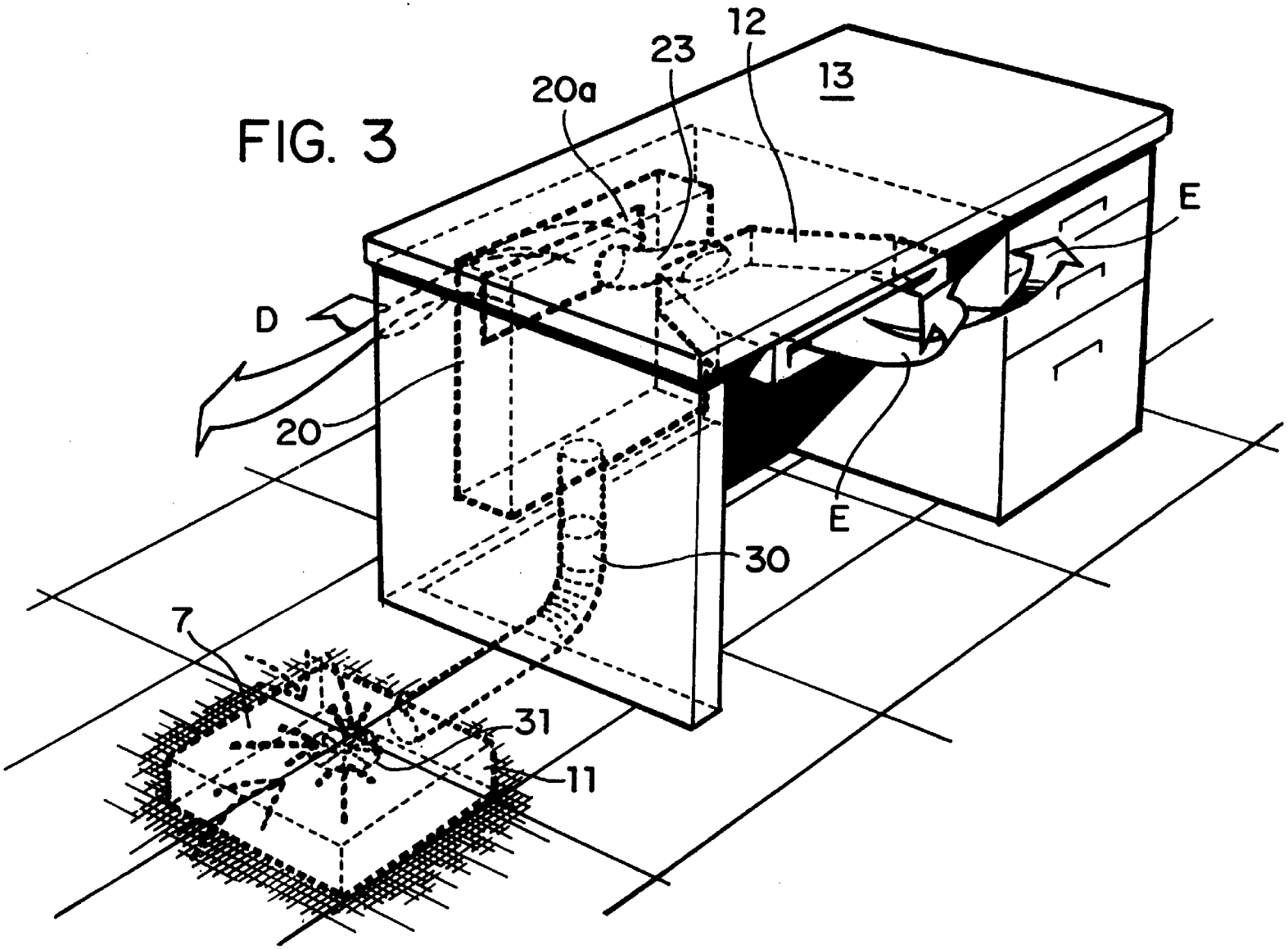
FIG. 3 is a perspective view of a workstation having an exterior air supply system.

FIG. 3 shows the same basic arrangement as was explained in FIG. 2 except that in this arrangement the conditioned air is derived from an under the floor major plenum or chamber 7. Again the same reference characters as were used in FIG. 1 are used again to identify the same elements. To this end, the desk shown at 13 has an air plenum 12 which again is connected to a plenum or air box 20 in the back of the desk by way of a tubular air hose 23. However, in this installation the conditioned air is derived from a smaller self-contained floor air terminal 11, (also see FIG. 1), having a fan 31 located therein. The smaller air terminal 11 is located in the major air plenum or air chamber 7 under the overall floor 9. As the fan 31 delivers conditioned air through the tubular air pipe 30 to the air plenum 20, the conditioned air is delivered to the plenum 12 under the desk by way of the air tube 23 and exits in the direction as is shown by (arrows E). The air flow within the chamber 12 is adjustable and therefore, the air flow within the air chamber 20 my be divided or diverted to the louver 20*a* in the back of the desk to exit in the direction as is shown by (arrows D). This type of an arrangement can well be used with a stand-alone desk.

Figure 4:
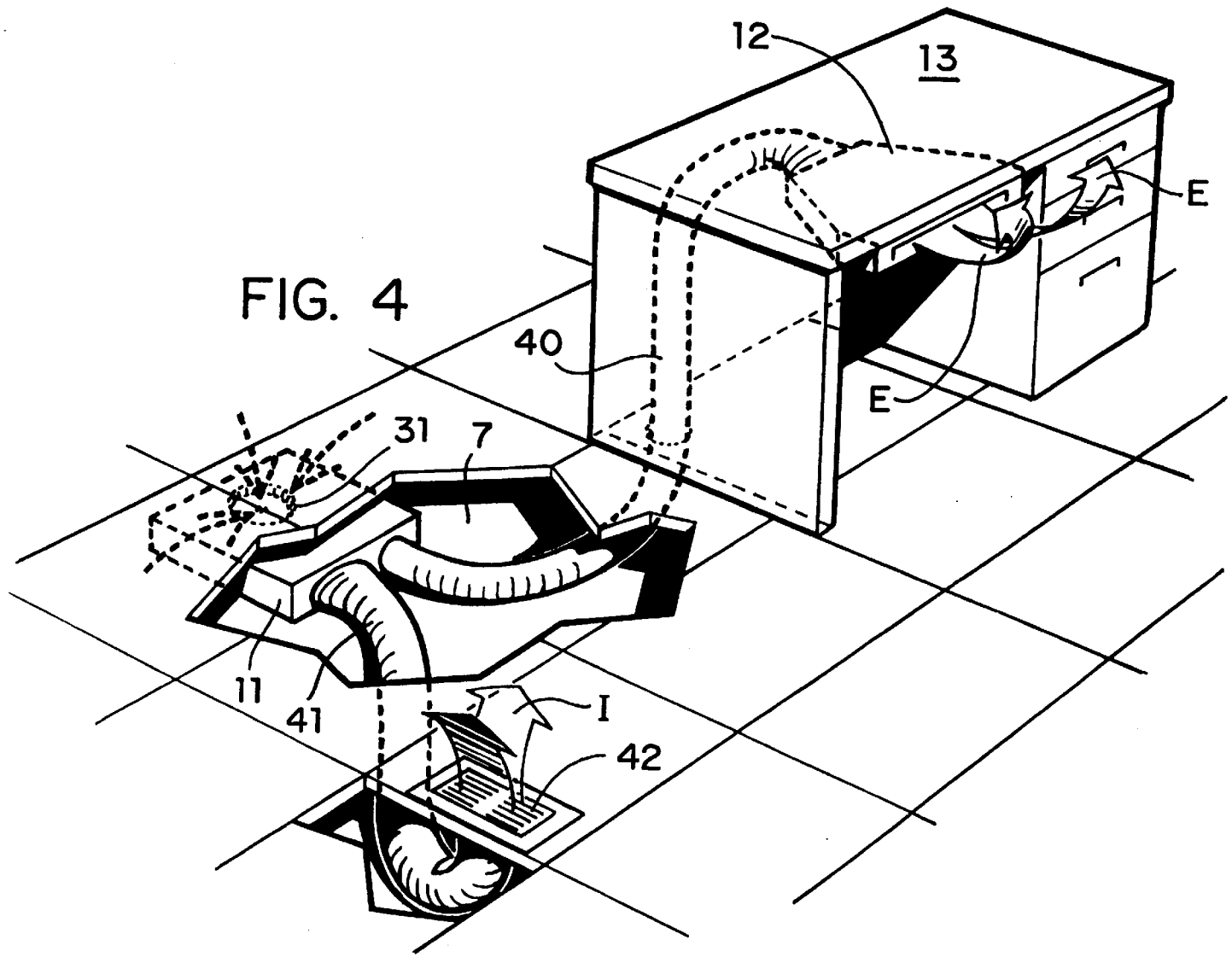
FIG. 4 is a perspective view of the workstation shown in FIG. 3 including a floor air outlet.

Turning now to FIG. 4 there is shown an installation wherein the same under floor air terminal 11 delivers conditioned air to exit at different locations. The same reference characters are used again as were in FIG. 1. In this installation, the air terminal 11 under the floor 9 in the major air plenum 7 delivers one stream of conditioned air by way of the fan 31 and the flexible tubular tube 40 to the air plenum 12 under the desk 13 to exit in the direction of (arrows E) and another stream of conditioned air is delivered to a floor grille 42 by way of a flexible tube 41 to exit in the direction of (arrows B). See also FIG. 1. Of course, it would be quite feasible to service two adjacent desks in the same manner.

Figure 5:
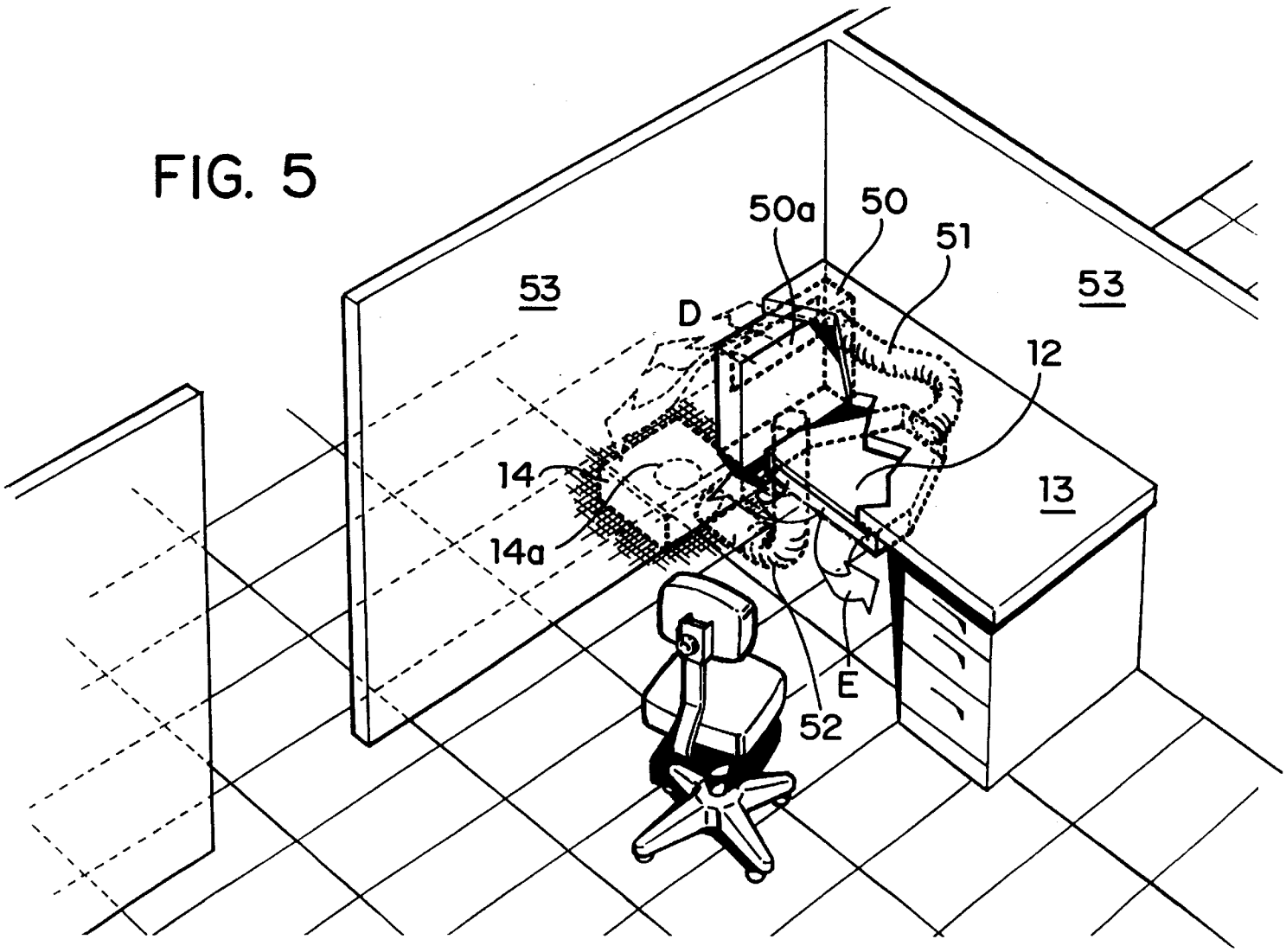
FIG. 5 is a perspective view of a workstation with divider walls with an air supply system on the divider wall and under a desk.

Turning now to FIG. 5 there is shown a different arrangement in servicing a personal air conditioned workstation. In this installation use is made of room dividers 53 to plan an open office space with the individual units thus affording more privacy for the occupant. For this purpose an air plenum or air box 50 is installed on the wall of the room divider 53. At this point it should noted that the air box 50 could also be mounted within the wall 53. Conditioned air is delivered to this air plenum 50 by way of the under floor terminal 14 (also see FIG. 1) having a fan 14a therein which directs conditioned air to the air plenum or box 50 on the wall 53 through the flexible air tube 62. From the air plenum in or on the wall 53, the conditioned air may be divided to be directed to the air plenum 12 under the top of desk 13 where the air will exit in the direction of (arrows E). Under the control of the occupant at the desk 13, the air prevailing in the air box 50 may be divided into a more or less forceful air stream to exit through the louver 50*a* (arrows D) into the general environment on the other side of the room divider.

Figure 6:
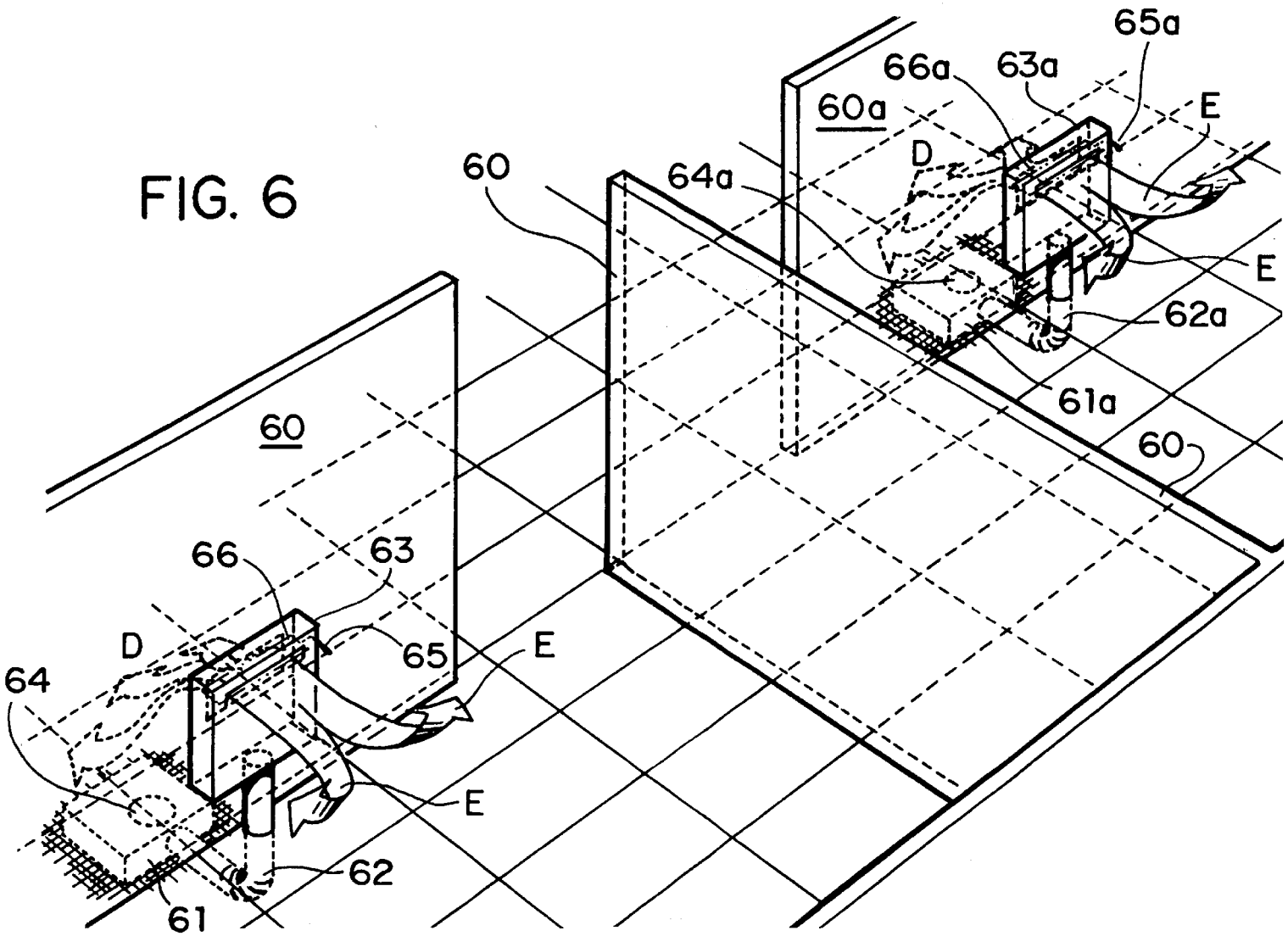
FIG. 6 is a perspective view of personalized air systems being applied to several room dividers.

FIG. 6 illustrates a different installation wherein various room dividers 60 and 60*a* are constructed so that conditioned air may be provided on both sides of the dividers so that personal comfort for persons on either side of the wall of the dividers may be realized regardless of the equipment being utilized at that location. To this end, there are under floor air terminals 61 and 61*a* each located in the vicinity of each of the walls 60 and 60*a* and each having a fan 64 and 64*a* providing conditioned air to each of the air plenums 63 and 63*a* on the walls of the room dividers 60 and 60*a* through the flexible tubes 62 and 62*a*. The conditioned air stream coming from each of the under floor terminals 61 and 61*a* to the air plenums or boxes 63 and 63*a*, respectively, can be divided or converted in each of the boxes 63 and 63*a* by baffles 65 and 65*a* which are operated by handles 66 and 66*a* so that the is conditioned air can exit through louvers on either side of the room divider walls as more or less divided air streams (arrows E) and (arrows D). The same effect can be achieved by adjustable louvers on the outside of the air plenums 63 and 63*a*. It can now be seen that many variations can be obtained in designing an open office space having the personal comfort of the various occupants in mind.

Figure 7:
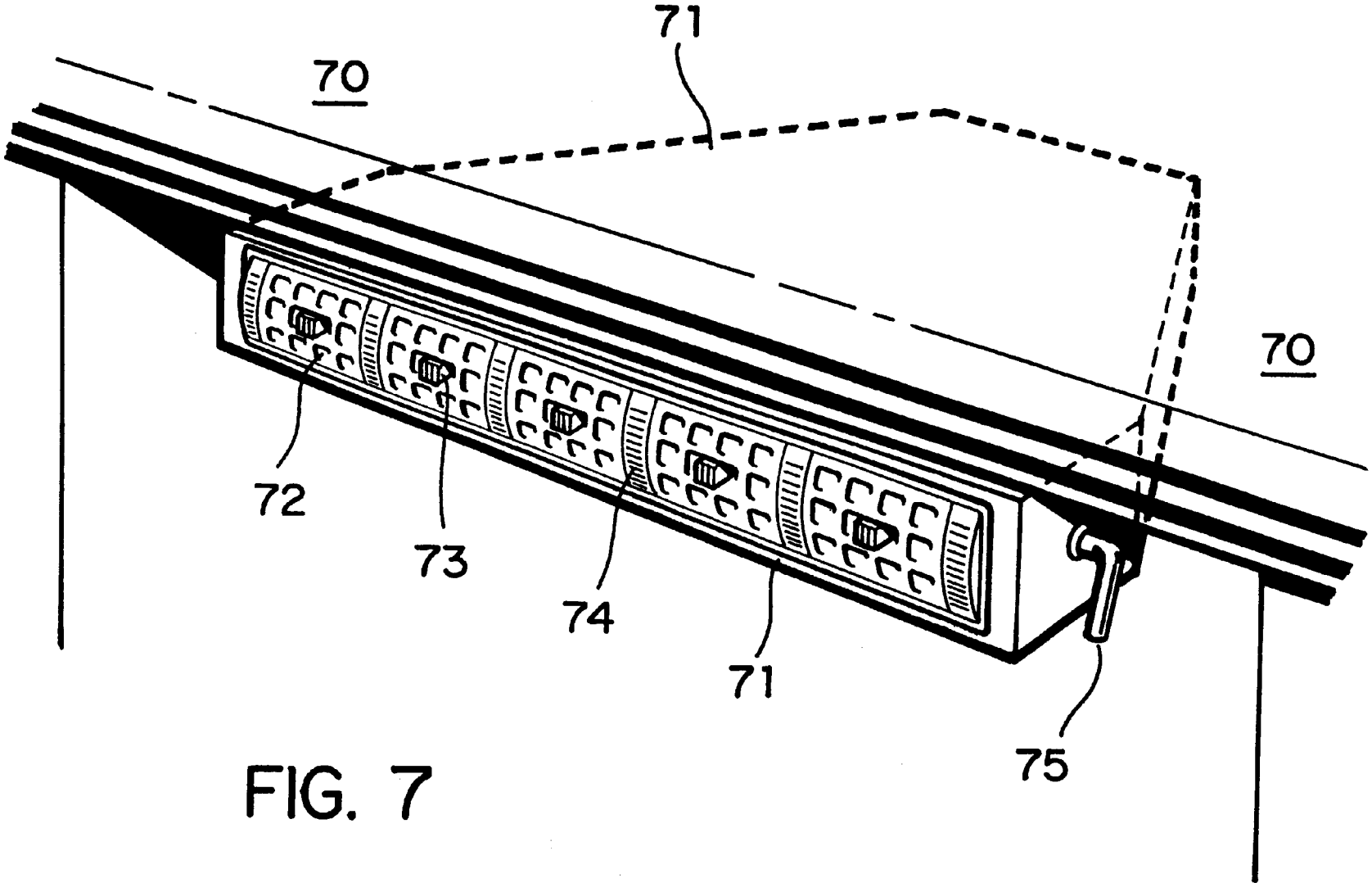
FIG. 7 illustrates the front of a personal air outlet plenum as it is mounted under the top surface of a desk.

Finally, turning to FIG. 7, there is illustrated the front of an air plenum 71 as it is installed under the top surface of a desk 70. As has been alluded to above, the air stream (arrow E) flowing from the interior of the air plenum 71 out of the outlets 72 can be directed into various directions (four way directions ) that is, either up or down or left and right. The adjustable grilles can be controlled to right and left by levers 73 or up and down by turning the louvers 74 to the desired directions. See previous FIGS. for air directions (arrows E). Also the air speed or volume of the conditioned air exiting through the air outlets can be controlled by the damper control lever 75. Referring back to FIG. 3, when this air control or damper lever 75 is activated, this will determine the amount of conditioned air flowing to the front of the desk 13 and to the occupant (arrow E) or the amount of air flowing through the louver 20*a* in the back of the desk 13 (arrow D).

SUMMARY OF THE INVENTION

In view of all of the above, it can now be seen that this system provides personal comfort control to office occupants, especially those in an open space office design. This system described satisfies the needs of a total air conditioning system. The various under floor terminals can be supplied with heat or cold to cover window and/or wall heat loss. The various illustrations, particularly FIG. 1, show how particles lighter than air, such as bacteria, mold, etc., are carried away and not recirculated, resulting in the creation of a cleaner environment. Because of the fact that there is a major under floor air conditioned plenum which is charged with conditioned air at or near the atmospheric pressure, the operating costs of a multi-floor building are substantially reduced. In conventional building air conditioning systems, where conditioned air is delivered under higher pressures, there is always the incident of heat loss or gain between floors and walls or between the various tiles of the floor. The elimination of all ducts moving the conditioned (hot or cold) from the one central station (the conditioning plant) to many different areas such as overhead air louvers, for example, contributes greatly to lower initial building costs and less expensive equipment and less building space. It should also be noted that the energy requirements for either heating or cooling the air introduced into the building can be much lower because of the above noted elimination of heat losses or gains throughout the building. Also, the fact that the operating air pressure of the conditioned air is at or near the atmospheric pressure contributes greatly to the savings of energy. This is so because of the use of the individual air terminals that are installed in the major air chamber or air plenum 7, which are essentially the final distribution movers of the conditioned air and only to places or locations where it is really needed. When the conditioned air is not needed, it is available but not wasted. In addition to all of the above, the general layout of an open office space or any floor of an office building, lends itself to much quicker and easier reconfigurations of all essential operations that are incident to operating an office.

What is claimed is:

1. A personalized air conditioned system consisting of a horizontal work surface having a back wall and being supported at a distance from a floor, a first air plenum is supported on said back wall, said first air plenum having a fan therein to generate a stream of air, said stream of air is delivered toward a second air plenum having a frontal air outlet by way of a flexible tube, said second air plenum is mounted under the surface of said horizontal work surface in such a manner so as to deliver a stream of air from said frontal air outlet of said second air plenum to a person situated in front of said horizontal work surface, said frontal outlet of said second air plenum has means for directing said stream of air emanating from said front of said second plenum in a multiple of directions, said second air plenum further has damper means for controlling the volume of the air emanating from said front of said second air plenum, said damper also is instrumental in diverting air in said first air plenum in an opposite direction to the outside environment through a vent located in said back wall.

2. The personalized air conditioned system of claim 1 including a filter located within said first air plenum.

3. The personalized air conditioned system of claim 1 including a switch for controlling the speed of said fan and its on and off state.

4. A personalized air conditioned system having a horizontal work surface and a back wall being supported by a floor, said floor having a major air plenum or air chamber underneath said floor, a self-contained air terminal having a driven fan therein being installed in said major air plenum under said floor, said fan delivering a stream of air into a first air plenum installed on said back wall by way of a first flexible air hose, said stream of air is further delivered by way of a second flexible air hose to a second air plenum being mounted under said horizontal work surface to deliver a stream of air toward a person situated in front of said workstation, said second air plenum having means for diverting some of said stream of air in said first air plenum to an outlet in said back wall to deliver a flow of air into the general environment.

5. The personalized air conditioning system of claim 4, wherein said air plenum is mounted within said room dividing partition walls.

6. The personalized air conditioned system of claim 4, wherein said self-contained air terminal in said major air plenum beneath said floor has another flexible air hose installed therein to deliver a stream of conditioned air to a separate outlet in said floor, said outlet in said floor is removed in distance from said workstation.

7. The personalized air conditioned system of claim 4 including several room partitions placed adjacent to said workstation wherein said first air plenum is mounted in one of said partitions.

8. A personalized air conditioned work environment including a multiple of room dividing partition walls, each of said walls having an air plenum mounted thereon and each of the walls is assigned to a workstation, a multiple of self-contained air terminals installed in an area beneath a floor on which said partitions and said workstations are supported, said area beneath said floor representing a major air plenum, said multiple of air terminals each having a driven fan therein to deliver a stream of air by way of a flexible tube to at least one or more of each of said air plenums mounted on each of said partition walls, each of said air plenums mounted on said partition walls has means for delivering a stream of conditioned air to either side of said walls.

9. The personalized air conditioned work environment of claim 8, wherein said means for delivering a stream of air of conditioned air to either side of said walls includes a damper having means for moving said damper into the air stream delivered from said air terminals.

10. A method of air conditioning an open office space having a multiple of personalized air conditioned workstations therein constituting a system, comprising the steps of:

creating a major air plenum beneath a floor supporting said multiple of workstations thereon;

operating said major air plenum at or near the atmospheric pressure;

further operating a multiple of smaller self-contained air terminals within said major air plenum, each of said smaller air terminals is generating a stream of conditioned air;

directing a first air stream from one of said smaller air terminals to a workstation having a second air plenum mounted under a horizontal surface, further directing said air stream toward a person situated in front of said workstation, said person controlling said stream of air in multiple directions, said person also diverting some of said air stream in said second plenum to exit in a direction which is away from the air stream toward said person;

further directing a second stream of air from said one of smaller air terminals and directing said second air stream to exit through said floor at a location remote from said workstation;

directing another air stream from another one of said smaller air terminals to an air plenum mounted on a partition wall which is supported on said floor, placing a workstation against said partition wall, delivering a further air stream from said air plenum on said wall to a second air plenum mounted under a horizontal surface of said workstation and directing said air stream toward a person situated in front of said workstation, said person directing said air stream emanating from said second air plenum in a multiple of directions and further diverting a stream of air in said air plenum on said wall through said wall in a direction away from said person;

further directing an air stream from each of several of said smaller air terminals to at least one of said air plenums mounted on each of a multiple of partition walls, thereafter diverting said air stream in each of said air plenums on said walls to exit on either side of said partition walls;

said multiple of smaller air plenums located within said major air plenum being the source for moving conditioned air to said various workstations.

* * * * *